US008001625B2

(12) United States Patent
Tillman

(10) Patent No.: US 8,001,625 B2
(45) Date of Patent: Aug. 23, 2011

(54) WATER CONSERVING IMPROVED TOILET

(76) Inventor: William R. Tillman, Vacaville, CA (US)

( * ) Notice: Subject to any disclaimer, the term of this patent is extended or adjusted under 35 U.S.C. 154(b) by 25 days.

(21) Appl. No.: 12/687,764

(22) Filed: Jan. 14, 2010

(65) Prior Publication Data

US 2011/0113541 A1 May 19, 2011

Related U.S. Application Data

(60) Provisional application No. 61/261,318, filed on Nov. 14, 2009.

(51) Int. Cl.
*E03D 9/06* (2006.01)

(52) U.S. Cl. ..... 4/341

(58) Field of Classification Search ..... 4/144.1, 4/301, 311, 341, 340
See application file for complete search history.

(56) References Cited

U.S. PATENT DOCUMENTS 6,061,844 A * 5/2000 Barton ..... 4/341
6,546,566 B1 * 4/2003 Geisel ..... 4/144.1

* cited by examiner

*Primary Examiner* — Lori Baker
(74) *Attorney, Agent, or Firm* — Mathew J. Temmerman; Temmerman Law Office

(57) ABSTRACT

An efficient dual-use toilet that provides a simple, easy-to-use and reliable solution to the problem of wasted toilet flush water is disclosed. The improved toilet provides a two-compartment toilet bowl, wherein the main bowl is used for solid waste and a hydrophobic secondary bowl is used for liquid waste. When only the secondary bowl is used, the toilet does not require flushing. When the toilet is flushed for solid wastes, water simultaneously cleanses the secondary bowl. Importantly, the drain line for the secondary bowl is configured such that during the flush cycle air is prevented coming back through the sewer system and into the household. The system is fully automatic and provides a very easy-to-learn "flush and forget" solution for the user. The amount of water flushed to the sewer system is greatly reduced, and consequently so is the burden on fresh water supply systems as well as the energy cost in required to deliver water.

15 Claims, 5 Drawing Sheets

WATER CONSERVING IMPROVED TOILET

RELATED APPLICATIONS

This application is related to previously filed U.S. provisional patent application Ser. No. 61/261,318, filed Nov. 14, 2009, entitled "Water Conserving Improved Toilet", which is incorporated by reference herein as if set out in full.

BACKGROUND

1. Field of the Invention

The present invention relates to plumbing products and in particular to water saving toilet designs.

2. Description of Related Art

The need for water conservation is widely recognized and has become an issue to many consumers. Limited resources, drought, water pollution, and rising populations have led to water shortages in many areas of the world. The problem has been recognized to the extent that many communities place regulations on the use of water and even impose fines when limits on water use are exceeded. Some cities are now recycling waste water back into the fresh water supply while other cities have been forced to limit their growth due to lack of fresh water and over use demands on insufficient wastewater treatment facilities.

The toilet is a water-using appliance so common that on average each household has more than one of them. According to the American Water Works Association Research Foundation, the largest daily user of water in the average home is the toilet, at 26.7% of the daily water used per home. This amount exceeds the shower at 16.8% and the washing machine at 21.7%. Calculating amounts from a standard toilet that uses 3.5 gallons of water per flush, one person can consume as much as 19.5 gallons per day, or 7,135 gallons per year. Newer low flow toilets use only 1.6 gallons of water per flush. However, even with a low flow toilet one person can even still use up to 10 gallons per day, due to propensity for individuals to flush these types of toilets more than once per use. The newest low flow toilets, while still using 1.6 gallons per flush, are much more efficient at removing solid wastes, and accordingly show a drop in double flushes. These toilets typically use less than 10 gallons per day. Even given these improved low flow toilets, there is room for improvement and it is well understood that more efficient toilet flush systems could save even more water beyond that already saved by current "low flow" toilets.

Because the above-recognized need to conserve water has created a market for new and improved low flow toilets, the prior art is thus plentiful and embodies many attempts by individuals and organizations to create ways to maximize the efficiency of the toilet flush system. Nearly all of the prior art attempts to address the problem through means to limit the amount of water used by each individual flush, either through early termination of the flush cycle, increased velocity of a smaller amount of water, or even dual flush systems utilizing two valves located at different levels within the toilet tank. See U.S. Pat. No. 6,510,563 to Jarosiinski et al, U.S. Pat. No. 4,485,501 to Kloner and U.S. Pat. No. 5,511,253 to Zamudio-Castillo et al. Some systems require the user to hold the valve open for as long as is necessary to complete the flush, such as in U.S. Pat. No. 5,129,110 to Richter.

The above systems are limited in that they only attempt to regulate the water use of a single flush, rather than creating a system wherein at least one flush per use is not always necessary. In addition, many of the prior art systems are very complex such that the reliability of the systems are questionable. Cost and difficulty of installation are further barriers to popularity and wide spread use of such systems. Finally, as mentioned above, many prior art systems require the use of the same amount of water for every flush, regardless of what is being flushed, thereby resulting in many flushes using too much water, while some other flushes use too little.

To overcome the limitations of the above prior art, non-flush liquid only toilets have been developed. These toilets are common in state parks and other outdoor areas where access to water is limited. While these systems can use zero water simply because the mere presence of gravity causes liquid waste to drain, they generally are malodorous if not properly maintained with an oil based cleaner. One common material used in toilet construction, porcelain, retains some liquid waste even after the majority has drained away. Thus, such systems would not be acceptable for common household use.

In order to overcome the limitations and problems inherent with the prior art toilet systems it is a first objective of the present invention to provide an improved toilet which is simple, efficient, low-flow solution which does not require a flush cycle after every toilet use.

It is a further objective of the present invention to provide an improved toilet with separate pathways for liquid and solid waste.

It is a further objective of the present invention to prevent overuse of water for flushing of liquid waste while preventing underuse of water for flushing of solid waste.

It is a further objective of the present invention to provide an improved toilet which both fits and works with existing plumbing structures and hardware.

Finally, it is a still further objective of the present invention to provide an improved toilet that is acceptable to the public due to its simplicity, reliability, and user friendliness.

SUMMARY OF THE INVENTION

The present invention is an efficient dual-use toilet that provides a simple, easy-to-use, and reliable solution to the problem of wasted toilet flush water. The present invention provides a two-compartment toilet bowl, wherein the main bowl is used for solid waste as in a conventional toilet, but wherein a secondary bowl is used for liquid waste and requires no flushing for proper drainage and waste removal. The secondary bowl is coated with a water repellent substance and drains to the sewer without the need for the user to flush the toilet. Water cleanses the secondary bowl when the toilet is flushed for solid wastes, Importantly, the drain line for the secondary bowl is configured such that during the flush cycle air is prevented from being transferred from the sewage system to the household.

The present invention thus provides the user with the option of a no-flush water saving cycle, or a standard flow flush cycle. The system is fully automatic and provides a very easy-to-learn "flush and forget" solution for the user. The amount of water flushed to the sewer system is greatly reduced, and consequently so is the burden on fresh water supply systems. Septic systems will work more efficiently and ground water pollution will be reduced.

These and other objects, advantages, features and aspects of the present invention will become apparent as the following description proceeds. To the accomplishment of the foregoing and related ends, the invention, then, comprises the features hereinafter more fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE INVENTION

The following description is presented to enable a person of ordinary skill in the art to make and use various aspects and examples of the present invention. Descriptions of specific materials, techniques, and applications are provided only as examples. Various modifications to the examples described herein will be readily apparent to those of ordinary skill in the art, and the general principles defined herein may be applied to other examples and applications without departing from the spirit and scope of the invention. Thus, the present invention is not intended to be limited to the examples described and shown, but is to be accorded the scope consistent with the appended claims.

Figure 1:
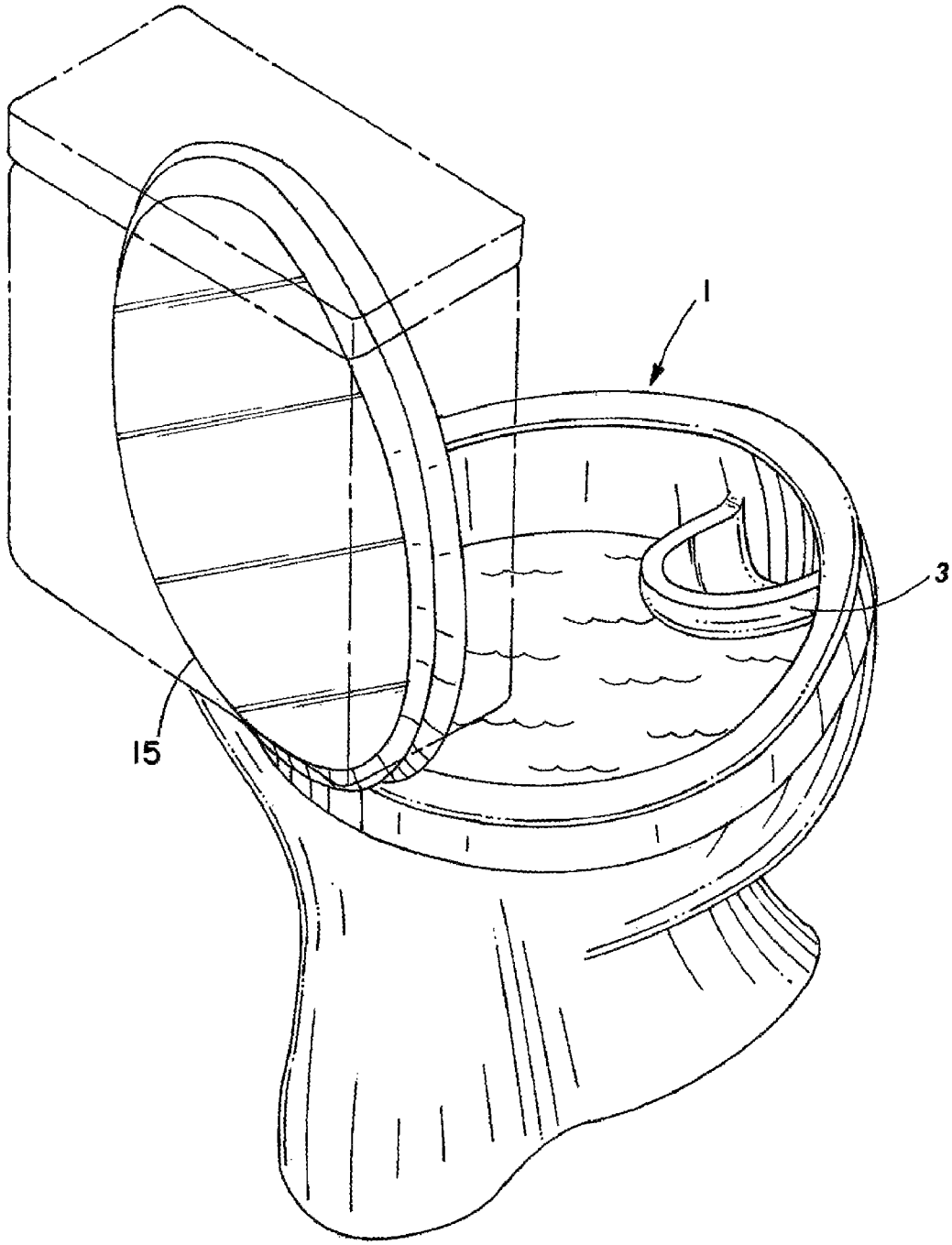
FIG. 1 depicts an upper rear perspective view of the present invention according to a preferred embodiment of the invention.

Referring first broadly to FIG. 1, an improved toilet 1 is depicted, the improved toilet includes a main or primary bowl (not labeled in this figure) as well as a secondary bowl 3 and like a conventional toilet a lid 15. Not shown, the toilet lid 15 may jointly cover the primary bowl and secondary toilet bowl 3. Like lid 15 and a toilet tank (not numbered) shown in phantom lines, most of the components of the Applicant's improved toilet are shared with the conventional toilet. The Toilet tank (not numbered) serves to provide water to said primary bowl.

Figure 2:
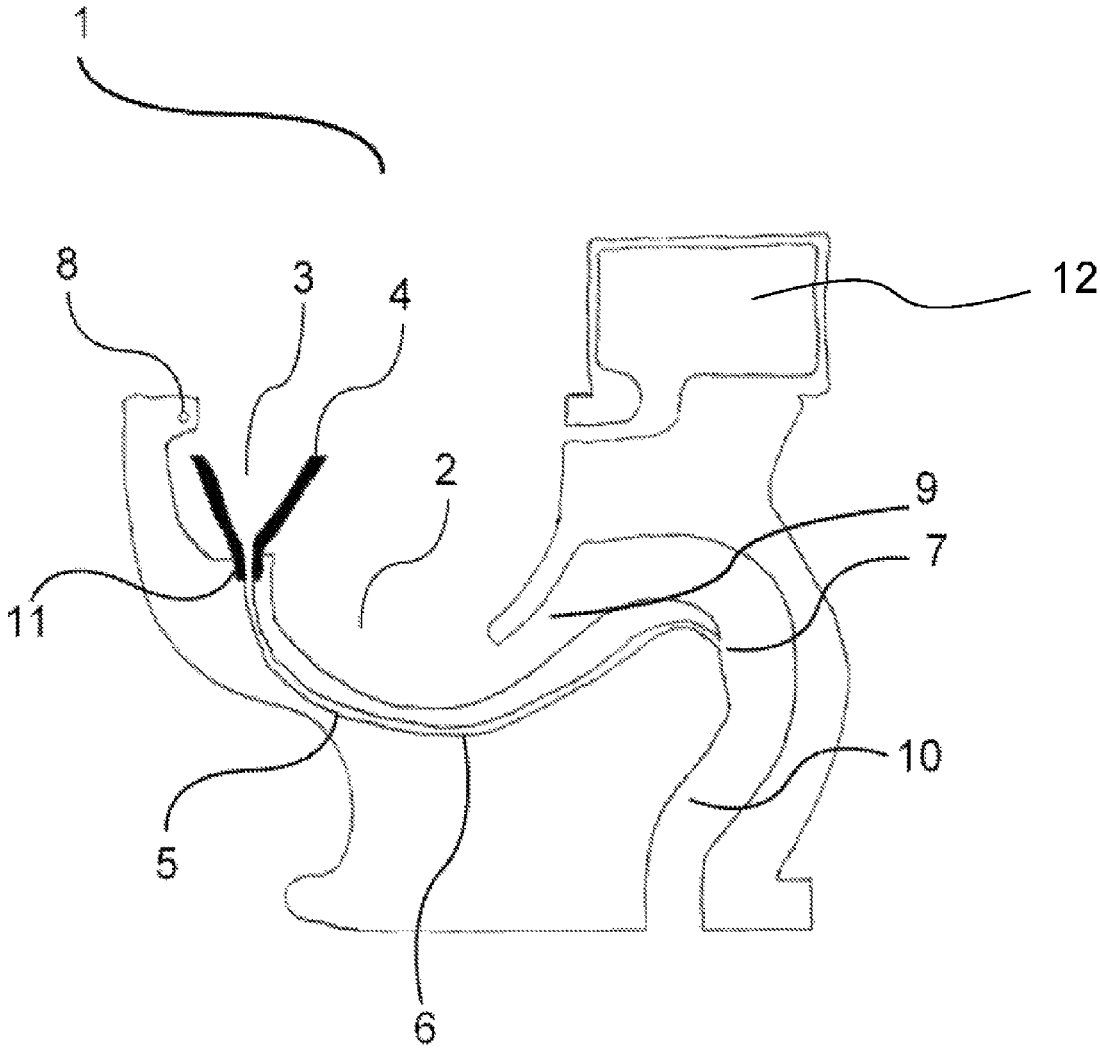
FIG. 2 depicts a cross-sectional view of the improved toilet according to the preferred embodiment of the invention.
Figure 3:
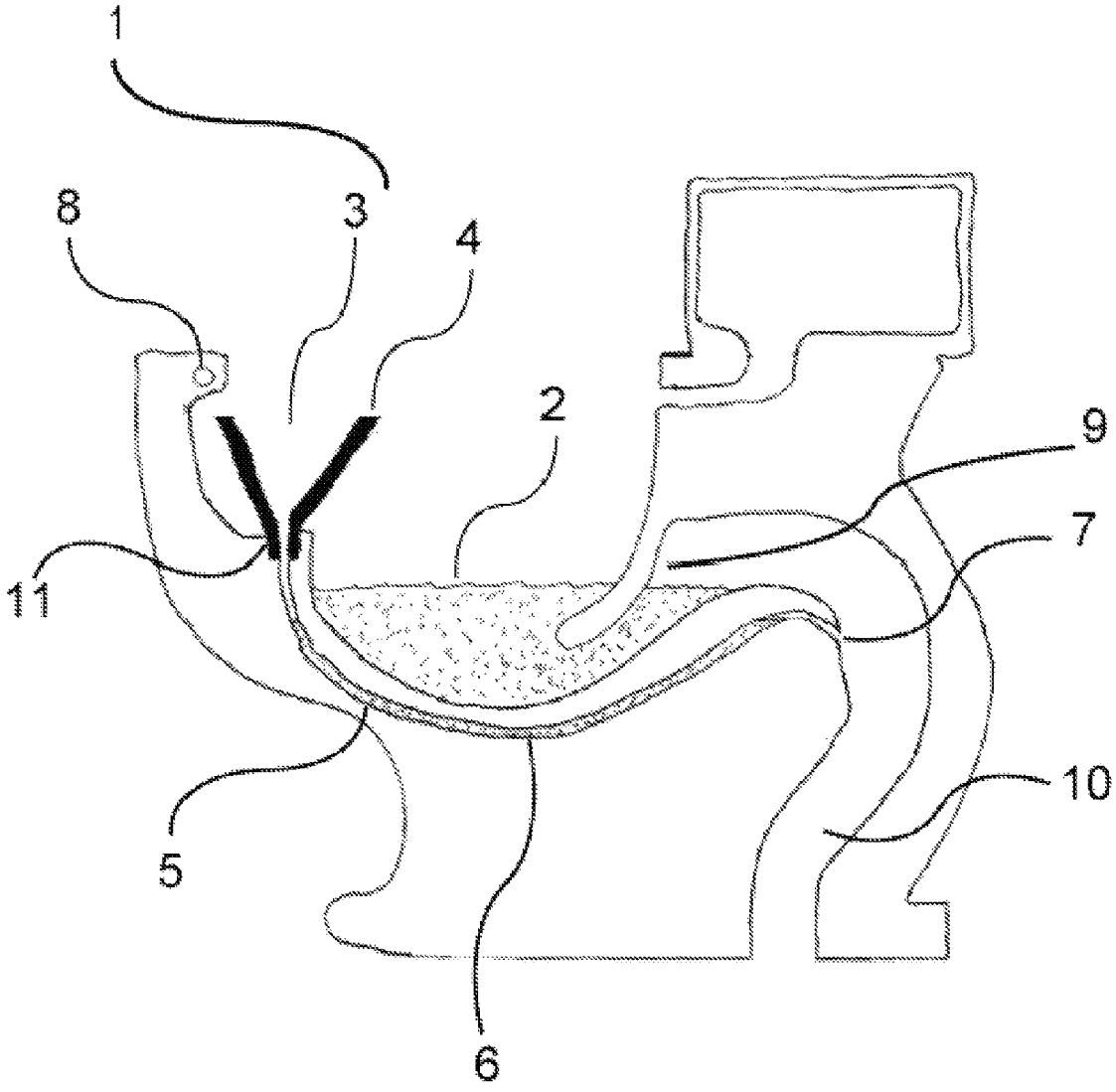
FIG. 3 depicts a cross-sectional view of the improved toilet according to the preferred embodiment of the invention wherein the water level is primed for the flush cycle.

Referring next to FIG. 2, a preferred exemplary embodiment of the improved toilet 1 is depicted. A cutaway cross sectional view of a waste disposal system is depicted. Instead of the standard one compartment toilet bowl found in conventional waste disposal systems, the current invention comprises a main or primary bowl 2 fluidly connected to a primary drain line pathway 10, the primary bowl 2 being used for solid waste as in a conventional toilet, and a secondary bowl 3 which is used for liquid waste and which requires no flushing. As can be seen the secondary bowl 3 is located within and towards the front of the primary bowl 2. The secondary bowl 2 in an alternative embodiment includes an insertable funnel 4 made up of a hydrophobic material. The insertable funnel 4 in this embodiment functions as the secondary bowl 3 and like secondary bowl 3 in the preferred embodiment provides a fluid connection to secondary drain line pathway 5, terminating in a secondary drain line terminus 7. The secondary drain line pathway 5 in a preferred embodiment has a minimum diameter less than one fifth the minimum diameter of the primary drain line pathway 10. The insertable funnel may be removed for cleaning if desired, or, if over time it loses its hydrophobic properties, becomes dry, discolored or cracked, it may be replaced without replacing the entire toilet. In yet another alternative embodiment the entire secondary bowl 3 and secondary bowl drain line pathway 5 is coated in a hydrophobic material. In yet another alternative embodiment no insertable funnel is included and instead a collection funnel (without insertable funnel) is used.

For solid waste disposal the improved toilet functions in the same manner as a conventional toilet, and presents no differences to the user when used in this manner. That is, liquid is added to the primary toilet bowl 2 (which contains the secondary bowl 3) at a first rate and is drawn toward a drain due to the combined force of gravity and a siphoning condition caused by the addition of the liquid. The addition of liquid at this first rate can also be considered a first means of draining the primary toilet bowl. As will be appreciated, this first means requires transferring water from a toilet tank 12 to the primary toilet bowl. However, when only a liquid waste use is desired, the user may position himself or herself such that the user's urine is directed to the secondary bowl 3. This will generally only require a slight repositioning by the user, and during such use liquid (urine) is added to the secondary toilet bowl 3 at a second rate, wherein it is drawn toward a drain due to the force of gravity, by exceeding the level of liquid that the trap can hold. The addition of liquid at this second rate can also be considered a second means of adding liquid. Note that this second means does not require the transfer of water from the toilet tank. Liquid added to the secondary toilet bowl 3 when liquid is added to the primary toilet bowl at said first rate will also be drawn toward a drain due to the force of gravity, by exceeding the level of liquid that the trap can hold. Said first rate is preferably at least five times greater than said second rate, and less preferably at least ten times greater. The secondary bowl 3 is much smaller than the primary bowl, and because it is neither positioned nor designed for solid waste the secondary drain line pathway 5 associated thereto is similarly much smaller than primary drain line pathway 10. In a preferred embodiment of the invention, the drain line pathway 5 is $3/16^{th}$ inch diameter tubing that is routed approximately as shown in FIGS. 2-5. The routing of the drain line pathway 5 is similar to that of a normal toilet drain, which causes the water in the toilet bowl to collect (rather than siphon uncontrollably) and acts as a seal against sewer gasses. Preferably, the path for the drain line pathway 5 is cast with the casting of the improved toilet 1 before firing along with the enlarged diameter at the opening 11 of the drain tube.

The (optional) secondary bowl insertable funnel 4 and the secondary drain line pathway 5 preferably comprise or are coated with a hydrophobic substance, and drain to the sewer without the user needing to flush the toilet. The hydrophobic properties ensure that little to no urine remains in the secondary bowl 2, which would otherwise be unpleasant for the user and possibly malodorous. Even though the secondary bowl and the drain line pathway are coated with or made from a hydrophobic material, cleansing of the secondary bowl and drain line pathway nevertheless occurs whenever the toilet is flushed to remove solid waste.

Figure 4:
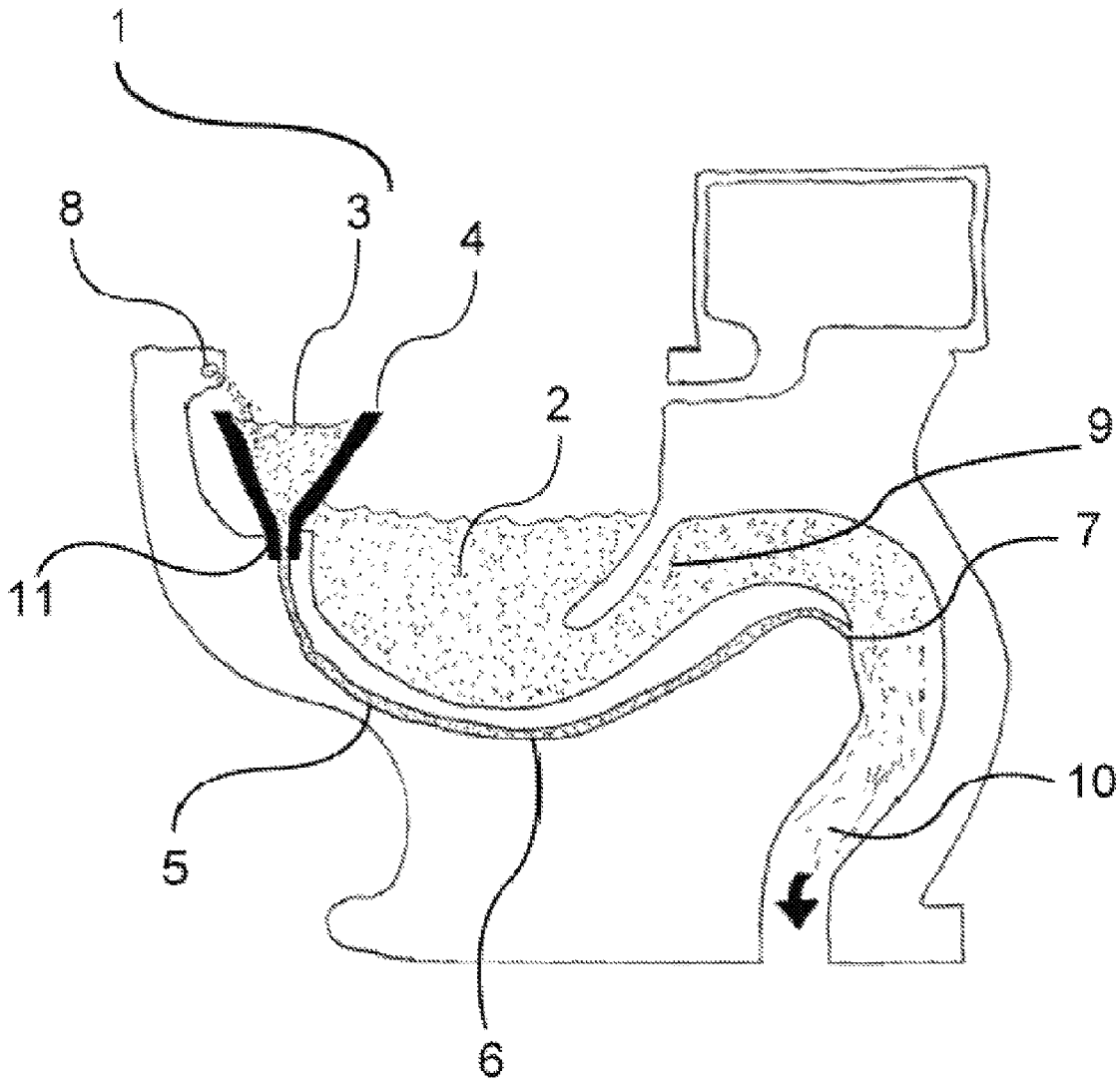
FIG. 4 depicts a cross-sectional view of the improved toilet according to the preferred embodiment of the invention wherein the water level reflects the toilet during the draining portion of the flush cycle.
Figure 5:
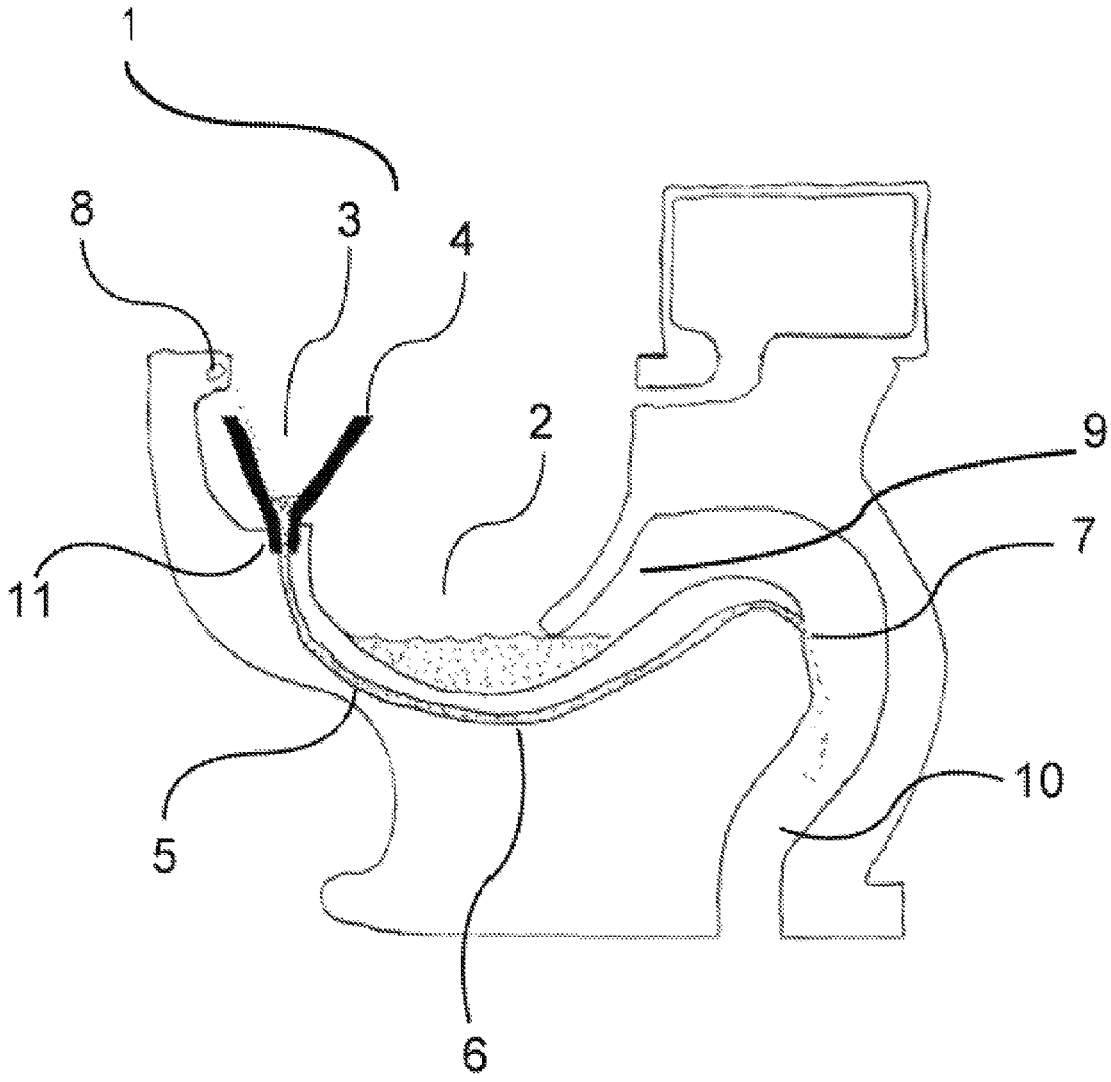
FIG. 5 depicts a cross-sectional view of the improved toilet according to the preferred embodiment of the invention wherein the water level reflects the toilet during the beginning of the refilling portion of the flush cycle.

As is illustrated in FIGS. 4 and 5, during a flush cycle water is introduced not only into the main bowl 2, but also into the secondary bowl 3 via water outlet 8. Typically, flushing is only needed to remove solid waste, but practically speaking there is nothing to prevent the user from flushing the toilet at any time. The amount of water to use over time is thus left up to the user. If for instance, a guest in the home of the improved toilet owner desires to use the toilet in the standard fashion, this is an option. Similarly, if the user wants to use the secondary bowl but nevertheless activate the flush cycle, then this is an option as well.

Continuing to refer to FIG. 2, the secondary drain line terminus 7 is positioned lower than the secondary bowl 3, but higher than the gas trap 6 shown in the drain tube path. The gas trap 6 in the drain tube path thus works in conjunction with gas trap 9 for the primary bowl so as to prevent air from the sewer being passed into the house and to prevent unwanted siphonic action. The only time the entire drain tube is filled with liquid is during the refilling portion of the flush cycle as can be seen in FIG. 5 during which time no air passes upwards from the sewer.

Even during the siphoning portion of the flush cycle as illustrated in FIG. 4, no air passes upwards from the sewer—this is a result of Bernoulli's principle which holds that for fluids in an ideal state, pressure and density are inversely related: in other words, a fast-moving fluid exerts less pressure than a slow moving fluid. In this case, as the toilet is flushed and the fast moving water moves out of the main bowl 2 and down the drain, it has a sucking effect on water within the secondary drain tube 5.

After all wastewater has been siphoned, water remains in the secondary drain tube 5 as shown in FIG. 5 during the refilling portion of the flush cycle. That is, the draining portion of the flush cycle ends while there is still water within the secondary drain tube 5. This important feature ensures that there is no chance of the system uncontrollably siphoning and/or allowing gasses from the sewer into the house.

The present invention may be used to directly replace a standard siphoning or non-siphoning toilet—no modifications to the drainage system, sewage system, or plumbing is necessary. Many newer homes often contain one new "low flow" toilet and one older toilet. In these homes the improved toilet disclosed herein may replace the low-flow toilet, which in turn may be used to replace the older toilet. Either gender may use the improved toilet as a urinal without need for activating the toilet flush cycle.

Given widespread increasingly stringent water efficiency requirements, and that fact that in the foreseeable future one can expect even further tightening of said efficiency requirements, it is possible that municipalities may become aware of the advantages of the present invention, and in fact require new toilet systems to be of the dual use variety that eliminate the need to flush for liquid waste uses. Widespread use of the improved toilet system disclosed herein could further reduce water consumption by 50%-80% relative to standard low flow toilets.

With respect to the above description then, it is to be realized that material disclosed in the applicant's drawings and description may be modified in certain ways while still producing the same result claimed by the applicant. Such variations are deemed readily apparent and obvious to one skilled in the art, and all equivalent relationships to those illustrated in the drawings and equations and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact disclosure shown and described, and accordingly, all suitable modifications and equivalents may be resorted to, falling within the scope of the invention.

I claim:

1. An improved water conserving dual purposes toilet for separate disposal of liquid and solid waste, the improved toilet comprising:

a. a secondary toilet bowl positioned within a primary toilet bowl;

b. a toilet tank for providing water to said primary toilet bowl simultaneous with providing water to said secondary toilet bowl;

c. a solid waste disposal system comprising a pathway having a primary pathway minimum diameter and further comprising said primary toilet bowl in connection with a drain; and d. a liquid waste disposal system comprising a secondary pathway having a secondary pathway minimum diameter less than ⅕ said primary pathway minimum diameter and further comprising said secondary toilet bowl in connection with a collection funnel and said drain.

2. The improved toilet according to claim 1 wherein said secondary pathway comprises a hydrophobic material.

3. The improved toilet according to claim 1 wherein:

a. said primary toilet bowl contains primary toilet bowl water and upon the addition of liquid at a first rate from said toilet tank to said primary toilet bowl simultaneous with said secondary toilet bowl said primary toilet bowl water is drawn toward said drain due to the combined force of gravity and a siphon;

b. said secondary toilet bowl comprises secondary toilet bowl water and upon the addition of liquid at said first rate from said toilet tank to said primary toilet bowl simultaneous with secondary toilet bowl, or a second rate to said secondary toilet bowl said secondary toilet bowl water is drawn toward said drain due to the force of gravity; and c. wherein said first rate is at least five times greater than said second rate.

4. The improved toilet according to claim 3 wherein said first rate is at least ten times greater than said second rate.

5. The improved toilet according to claim 3 wherein said secondary pathway comprises a hydrophobic material.

6. A human waste disposal system wherein liquid waste is drained to a sewer system without the use of water while solid waste is drained to said sewer system with the use of water, the system comprising:

a. a primary toilet bowl and a secondary toilet bowl located within said primary toilet bowl;

b. said primary and said secondary toilet bowl each configured for receipt of liquid at a first and second rate, such that i. upon receipt of liquid at either said first rate into said primary toilet bowl simultaneous with said secondary toilet bowl or said second rate into said secondary toilet bowl, said liquid received into said secondary toilet bowl flows through a trap to a drain and replaces the liquid in said trap; and ii. upon receipt of liquid at said first rate into said primary toilet bowl, said liquid received into said primary toilet bowl flows through a trap to a drain thereby creating a siphoning condition that partially empties said primary toilet bowl and upon receipt of liquid at said second rate said primary toilet bowl does not create said siphoning condition.

7. The improved toilet according to claim 6 wherein said first rate is at least five times greater than said second rate.

8. The improved toilet according to claim 7 wherein said first rate is at least ten times greater than said second rate.

9. The human waste disposal system according to claim 6 wherein said secondary toilet bowl further comprises:

a. a collection funnel; and b. a narrow conduit in connection with said drain.

10. The human waste disposal system according to claim 9 wherein said collection funnel comprises a hydrophobic material.

11. An improved water conserving dual purpose toilet for separate disposal of liquid and solid waste, the improved toilet comprising:

a. a primary toilet bowl and a secondary toilet bowl which are jointly covered by a single toilet seat and jointly connected to a drain;

b. a first means for draining primary toilet bowl water from said primary toilet bowl to said drain, the first means requiring transferring water from a toilet tank to said primary toilet bowl;

c. a second means for draining liquid waste from said secondary toilet bowl to said drain, the second means not requiring the transfer of water from said toilet tank.

12. The improved toilet according to claim 11 wherein said secondary toilet bowl is within said primary toilet bowl.

13. The improved toilet according to claim 12 wherein said first means further rinses said secondary toilet bowl.

14. The improved toilet according to claim 13 wherein said first means further rinses said secondary toilet bowl with sufficient water to replace any liquid which was between said secondary toilet bowl and said drain.

15. The improved toilet according to claim 14 wherein said secondary toilet bowl comprises a hydrophobic material.

* * * * *